US005899273A

United States Patent [19]

Jung

[11] Patent Number: 5,899,273

[45] Date of Patent: May 4, 1999

[54] EDUCTOR/EJECTOR APPARATUS AND THE PROCESS FOR INCREASING FLUID RECOVERY FROM GEOTHERMAL WELLS

[76] Inventor: Douglas B. Jung, 3209 Franz Valley Rd., Santa Rosa, Calif. 95404

[21] Appl. No.: 08/582,425

[22] Filed: Jan. 3, 1996

[51] Int. Cl.[6] ..... E21B 43/12; E21B 43/18

[52] U.S. Cl. ..... 166/370; 166/52; 166/267

[58] Field of Search ..... 166/52, 105, 91.1, 166/267, 370; 60/641.2, 641.3, 641.4, 641.5

[56] References Cited

U.S. PATENT DOCUMENTS 4,261,708 4/1981 Gallagher ..... 60/641.2 X 5,547,021 8/1996 Raden ..... 166/267 X

*Primary Examiner*—David J. Bagnell

[57] ABSTRACT

This invention is comprised of a method and apparatus for increasing fluid flow from weak geothermal wells that marginally or cannot, on its own, flow into a production gathering system by passive use of squandered energy inherent in a strong well geothermal well. The apparatus is comprised of a venturi-like nozzle called an eductor and associated piping connected to both the weak and the strong wells and the production gathering system. The method utilizes the eductor apparatus to harness some of the energy from strong well to induce fluid flow from the weak well by reducing the flowing back-pressure for the weaker well.

1 Claim, 2 Drawing Sheets

EDUCTOR/EJECTOR APPARATUS AND THE PROCESS FOR INCREASING FLUID RECOVERY FROM GEOTHERMAL WELLS

BACKGROUND OF THE INVENTION

1. The Field of the Invention

The present invention relates to a passive (no external power input required) apparatus useful for enhancing (increasing) geothermal fluid production from a weak (low pressure) wells by using strong (higher pressure) wells.

2. The Relevant Technology

In geothermal hot water flash (brine or two-phase) systems, multiple wells flow into a fluid gathering system (pipelines) to feed a steam turbine driven electric power plant. The production pressure at the surface in some of the wells may be declining or weak, and produce at marginal rates or not at all if the gathering system pipeline pressure (back-pressure) is too high to allow the required flow. To decrease this back-pressure, the strong wells are often throttled back to allow flow from the weak wells resulting in decrease fluid production from the strong wells. This throttling process reduces the system back-pressure allowing the weaker wells to flow into the pipeline, but curtails production from the strong wells. At some point, as the pressure in the underground reservoir declines with cumulative production, the weaker wells will cease to flow.

Normally, new wells are drilled to make up for the production short-fall. Alternatively, a larger pipeline or a separator station and brine lines are installed on two-phase flash systems to reduce the pressure loss thus allowing the weaker wells to enter the system. Larger diameter, two-phase flow lines can be a concern since oversized pipes can result in flow instability such as dangerous slugging conditions. Separator stations can be used but are very expensive especially if brine transfer pumps are required.

Geothermal two-phase wells will cease to produce fluid when the flowing pressure declines below the maximum shut-in pressure at the well-head. For each psi (pounds per square inch) reduction in effective flowing back-pressure, an increase of 2% to 15% in the total mass flow rate from the lower pressure wells can be obtained. This bonus capacity, in conjunction with keeping the weak wells flowing, can delay supplemental drilling. Geothermal wells cost from $1,500,000 to $3,000,000 to drill and complete. In some geothermal hot water flash fields, up to one-third (⅓) of the original production wells are shut in due to high production pressures (high back pressure).

SUMMARY OF THE PRESENT INVENTION

A new and novel apparatus utilizing a short converging pipe segment (a type of venturi), has been designed and is being developed to enhance the production from weak flowing wells. In areas where weak wells cannot flow against high back-pressure, or produce at marginal rates, this new production enhancement tool can be economically used to keep these dying wells on-line. An eductor apparatus (a device that educes or draws out by eduction) can significantly reduce the effective fluid back-pressure against these wells and allow them to flow at higher rates into the system.

The apparatus utilizes the stronger throttling wells to essentially draw or suck the geothermal fluid out from these weak producers. The flow from a strong well is accelerated to drop the static pressure at the throat or the apparatus. This condition reduces the effective back-pressure for the weak wells and allows greater flow into the pipeline. The combined fluid is conditioned and re-compressed at a higher pressure than at the suction inlet of the apparatus. The combined production can flow into the power plant at a higher pressure, and at a greater flow rate than with the conventional throttling method.

The eductor apparatus has no moving parts, and does not require any external power or control equipment, it is a passive system. Large eductors may be effectively used with line diameters of 10 inches to perhaps in excess of 36 inches. The installation costs are very economical when compared to building larger pipelines or drilling new wells. In areas where this type of velocity inducing devices can be employed (where at least one strong well and one weak well exist in proximity), the potential for economic savings can be very significant. When market cost of energy prices are low, it is increasingly imperative to seek out low cost alternatives to keep overall costs down. This new apparatus can help reduce overall cost.

BRIEF DESCRIPTION OF THE DRAWINGS

The present invention maybe better understood and its advantages will be apparent to those skilled in the art by reference to the accompanying drawings, wherein like reference numerals refer to like elements in the several figures. These drawings represent only typical embodiments of the invention and are not therefore to be considered limiting of its scope.

FIG. 1 is a simplified process diagram showing the method of applying the eductor apparatus to two-phase fluid systems.

FIG. 2 is a simplified process diagram showing the method of applying the eductor apparatus to single phase (steam) systems.

DETAILED DESCRIPTION OF THE PREFERRED EMBODIMENTS

The eductor apparatus ("apparatus") utilizes the stronger throttling wells to essentially suck the production out from the weak wells. The flow from a strong well is accelerated through the narrow zone of the apparatus to drop the static pressure at the throat of the narrow zone where that pressure is low enough to allow the weak wells to enter the eductor apparatus at this suction inlet. The commingled flow is conditioned and recompressed at the exit of the apparatus to a higher pressure than at the suction inlet. The combined production can flow into the power plant at a higher pressure, and at a greater flow rate than with the conventional throttling method described earlier.

Figure 1:
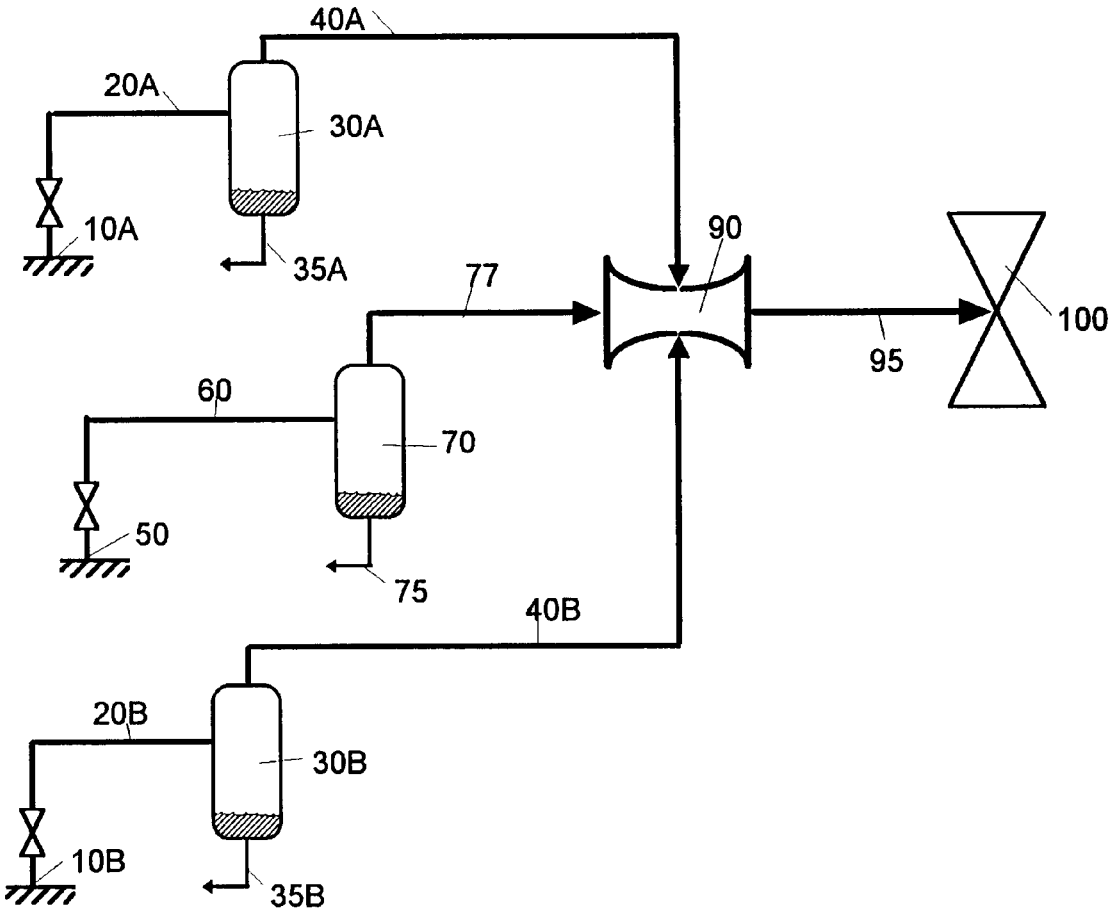
FIGS. 1 and 2 are simplified, schematic process diagrams of pipelines, pipeline components and power generation equipment using standard piping symbols.

Referring to FIG. 1, which is a simplified process diagram showing a method of applying the eductor apparatus to a geothermal wells with a well-head separator system and eductor apparatus, the production from the weak wells 10A/10B flows to the separators 30A/30B along pipelines 20A/20B. The discharge brine from each weak well separator is directed to other areas along pipelines 35A/35B. The steam fractions from the weak well separators flow along the pipelines 40A/40B and are directed into the narrow region or suction inlet of the apparatus 90. Fluid from the higher pressure well 50 flows into the pipeline 60 and into the separator 70. The discharge brine from the strong well separator is diverted elsewhere along a brine pipeline 75. The higher pressure steam from the this separator flows through a pipeline 77 and into the nozzle area eductor apparatus. The accelerated steam velocity through the narrow region of the apparatus creates a lower pressure zone in the apparatus and is combined with the lower pressure steam from the low pressure pipelines 40A/40B and flows out of the apparatus through pipeline 95 and into the turbine/generator unit 100 for electrical power generation. It should be noted that additional weak and/or strong wells may be added to the system at the proper process points and, at a minimum, one weak well and one strong well is needed to operate the apparatus using this method.

Figure 2:
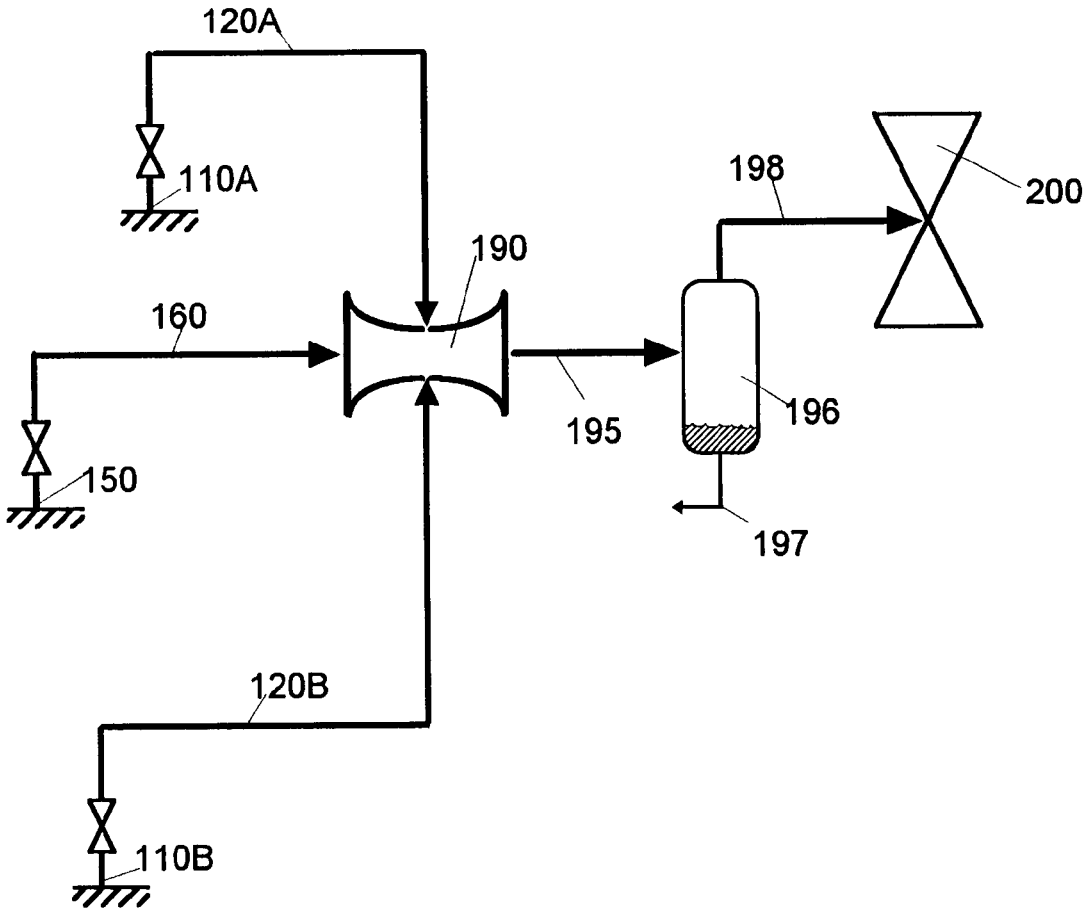

Referring to FIG. 2, which is a simplified process diagram showing a method of applying the eductor apparatus directly two-phase geothermal wells followed by separation, the weak production from wells 110A/110B flows to the surface along pipeline 120A/120B into the suction side of the eductor apparatus 190. Fluid from the higher pressure well 150 flows in the pipeline 160 into the nozzle of the eductor apparatus. The accelerated fluid velocity through the apparatus creates a lower pressure zone in the narrow region of the apparatus which is combined with the lower pressure fluid from 120A/120B and flows through pipeline 195 into the separator 196 where the liquid portion of the fluid, or brine, is removed through pipeline 197. The separated steam proceeds along the main pipeline 198 and into the turbine/generator unit 200 for electrical power generation. It should be noted that additional weak and/or strong wells may be added to the system at the proper process points and, at a minimum, one weak well and one strong well is needed to operate the apparatus using this method.

What is claimed in this invention and desired to be secured by the United States Letters Patents is:

1. A method of increasing fluid production from geothermal wells comprising:

supplying produced fluid from a high pressure geothermal well to a high pressure inlet of an eductor;

supplying produced fluid from a low pressure geothermal well to a suction intake of the eductor;

providing a high pressure outlet on the eductor wherein the combined supplied fluids exit the eductor into a pipeline.

* * * * *